US006263631B1

(12) United States Patent
Nisbett et al.

(10) Patent No.: US 6,263,631 B1
(45) Date of Patent: Jul. 24, 2001

(54) SEALING PLATE FOR WALL TILE

(76) Inventors: William K. Nisbett, Box 30, Group 3, R.R. #1, Dugald, Manitoba (CA), R0E 0K0; James R. Lickley, 71 Lonsdale Drive, Winnipeg, Manitoba (CA), R2Y 0N4

( * ) Notice: Subject to any disclaimer, the term of this patent is extended or adjusted under 35 U.S.C. 154(b) by 0 days.

(21) Appl. No.: 09/468,947

(22) Filed: Dec. 22, 1999

Related U.S. Application Data

(60) Provisional application No. 60/113,818, filed on Dec. 23, 1998, and provisional application No. 60/167,692, filed on Nov. 29, 1999.

(51) Int. Cl.[7] ..... E04B 5/00

(52) U.S. Cl. ..... 52/413; 52/426; 52/431; 52/432; 52/442; 52/700; 52/405.3; 52/562; 52/568

(58) Field of Search ..... 52/426, 431, 432, 52/438, 442, 405.3, 562, 568, 700, 413

(56) References Cited

U.S. PATENT DOCUMENTS 4,541,211 * 9/1985 Garrett ..... 52/426
4,763,456 * 8/1988 Giannuzzi ..... 52/426
5,987,830 * 11/1999 Worley ..... 52/426
6,131,360 * 10/2000 Dalen ..... 52/426

* cited by examiner

*Primary Examiner*—Christopher T. Kent
*Assistant Examiner*—Dennis L. Dorsey
(74) *Attorney, Agent, or Firm*—Adrian D. Battison

(57) ABSTRACT

A sealing plate for use with a building, the building having an inner wall structure, an air impermeable sheet material for covering the inner wall structure and defining an air impermeable barrier, an insulation material on top of the sheet material and an outer wall structure outside of the insulation material uses a wall tie mounted on the inner wall structure and to attached to the outer wall structure for support. The wall tie has a first plate portion which is vertically mounted on the inner wall structure, a second plate portion connected to the first plate portion and extending therefrom inserted vertically through a slit on the sheet material, through a second slit on the insulation material, the second portion has at least one hole in which a suitable mount means is inserted and attached to the outer wall structure connecting the inner wall structure and the outer wall structure. A sealing plate between the sheet material and the insulation material has a generally flat plate body defining a covering portion to create a seal around a sealing material such that the sealing material is trapped in the sealing plate, a slot on the body for receiving the wall tie and a raised protrusion on the body at the slot for allowing the sealing material to bead.

8 Claims, 5 Drawing Sheets

SEALING PLATE FOR WALL TILE

This application claims priority to Provisional Application No. 60/113,818 filed Dec. 23, 1998 and No. 60/167,692 filed Nov. 29, 1999.

The present invention relates to a sealing plate for wall ties using a combination of sealing material and a plate which is formed to create a complete seal with the wall tie.

BACKGROUND OF THE INVENTION

As commonly known to one in the art of construction, a wall tie is used to connect an outside structure of a building made of brick or the like to an inside wall structure. The inside wall structure provides support for the outside structure. In construction of the wall, a inside wall structure is built in which the wall tie is mounted then layers of material are placed overtop of the inside wall structure. The covering layer of material must have slits which are cut to allow the wall tie to be inserted through.

These slits are very hard to precisely measure and need a considerable amount of time to seal. In the past, a worker would simply place a bead of cocking around the wall tie and spread it around with a suitable tool. Which takes up a lot of time, energy and materials and is rarely considered a suitable seal. Pressure tests are done to check for air passage through the slits and usually air does pass. When the insulation is placed on top of the cover material the seal is usually completely lost.

SUMMARY OF THE INVENTION

The present invention provides a plate which is used to create an adequate seal. A worker simply has to apply a single bead of flowable sealant material around the tie and place the plate on top. The plate is designed to evenly seal the slit and remains in place when the insulation is placed on top. The present invention takes up less time, energy and materials. Since the ties, presently sold on the market, are of considerable cost and are regularly used along with increasing requirements by engineers for a complete seal the use of the present invention is essential. The present invention supports the flowable sealant material under wind loads which cause the wall to expand.

According to one aspect of the invention there is provided a sealing plate for use with a building, the building comprising;

an inner wall structure;

an air impermeable sheet material for covering the inner wall structure and defining an air impermeable barrier;

an insulation material on top of the sheet material;

an outer wall structure outside of the insulation material;

a wall tie mounted on the inner wall structure arranged to attach to the outer wall structure for support;

the wall tie comprising a first plate portion which is vertically mounted on the inner wall structure, a second plate portion connected to the first plate portion and extending therefrom inserted vertically through a slit on the sheet material, through a second slit on the insulation material, the second portion has at least one hole in which a suitable mount means is inserted and attached to the outer wall structure connecting the inner wall structure and the outer wall structure;

the sealing plate between the material for covering the inner wall and the insulation material comprising;

a generally flat plate body defining a covering portion to create a seal around a sealing material such that the sealing material is trapped in the sealing plate.

a slot on the body for receiving the wall tie;

a raised protrusion on the body at the slot for allowing the sealing material to bead.

Preferably the wall tie has a fold portion at the first plate portion is folded at a right angle to correspond with the inner wall structure and wherein a second raised protrusion on the body is arranged for receiving the folded portion.

Preferably the sealing material is applied to the perimeter of the wall tie such that the sealing material fills the raised protrusion on the body.

Preferably the plate has an inner surface and an outer surface relative to the wall, the raised protrusion is located on the outer surface and the bead of sealant material is applied around the wall tie such that the interior of the raised protrusion at the inner surface is filled to provide a seal around the wall tie.

Preferably the raised protrusion extends upwardly at an incline from the outer surface.

According to another aspect of the present invention there is provided a building comprising;

an inner wall structure;

an air impermeable sheet material for covering the inner wall structure and defining an air impermeable barrier;

an insulation material on top of the sheet material;

an outer wall structure outside of the insulation material;

a wall tie mounted on the inner wall structure arranged to attach to the outer wall structure for support;

the wall tie comprising a first plate portion which is vertically mounted on the inner wall structure, a second plate portion connected to the first plate portion and extending therefrom inserted vertically through a slit on the sheet material, through a second slit on the insulation material, the second portion has at least one hole in which a suitable mount means is inserted and attached to the outer wall structure connecting the inner wall structure and the outer wall structure;

and a sealing plate between the material for covering the inner wall and the insulation material comprising;

a generally flat plate body defining a covering portion to create a seal around a sealing material such that the sealing material is trapped in the sealing plate.

a slot on the body for receiving the wall tie;

a raised protrusion on the body at the slot for allowing the sealing material to bead.

Preferably the wall tie has a fold portion at the first plate portion is folded at a right angle to correspond with the inner wall structure and wherein the sealing plate has a second raised protrusion on the body is arranged for receiving the folded portion.

Preferably the sealing material is applied to the perimeter of the wall tie such that the sealing material fills the raised protrusion on the body.

Preferably the plate has an inner surface and an outer surface relative to the wall, the raised protrusion is located on the outer surface and the bead of sealant material is applied around the wall tie such that the interior of the raised protrusion at the inner surface is filled to provide a seal around the wall tie.

Preferably the raised protrusion extends upwardly at an incline from the outer surface.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
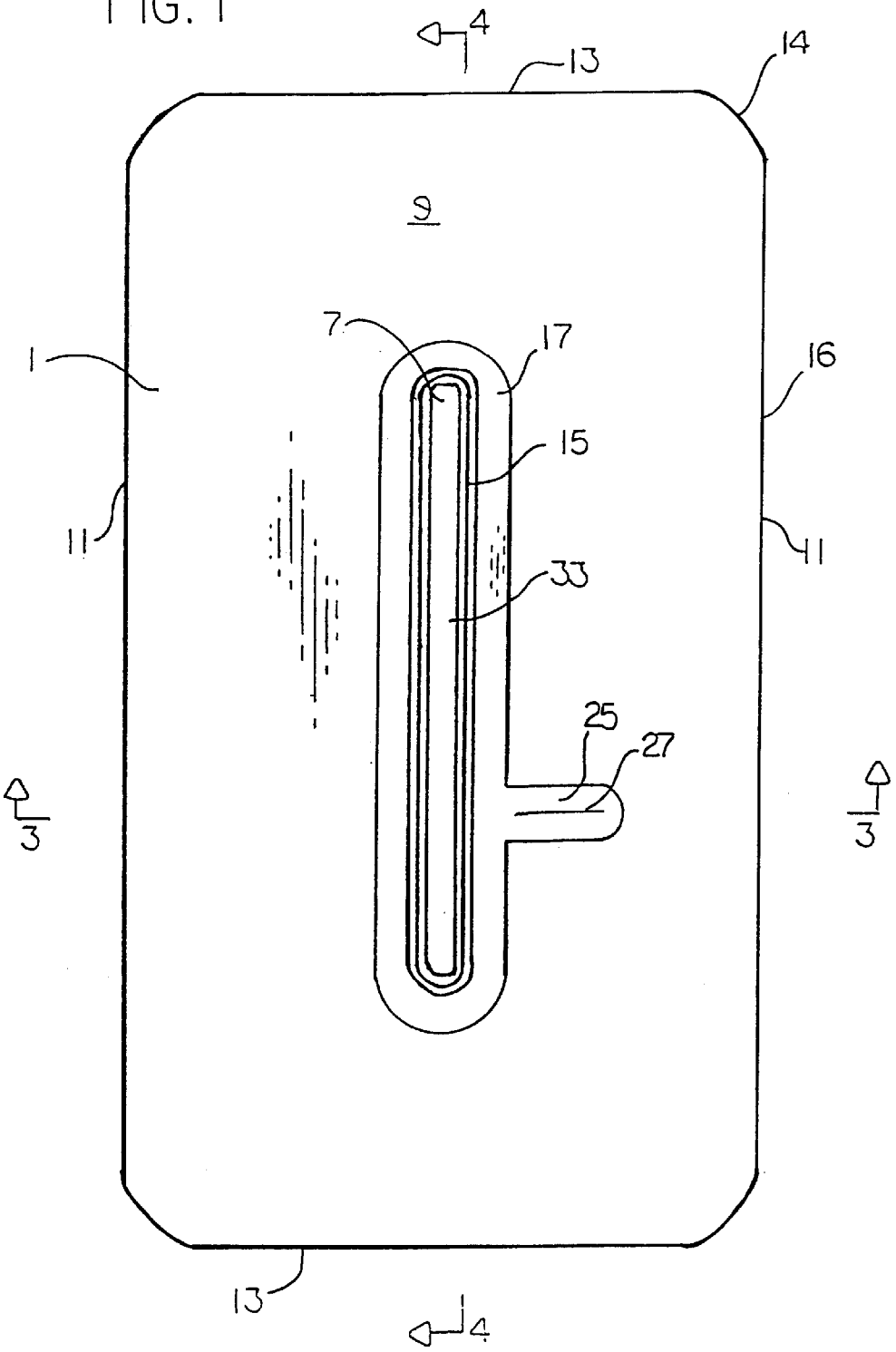
FIG. 1 is a front elevational view of the present invention mounted on the building
Figure 2:
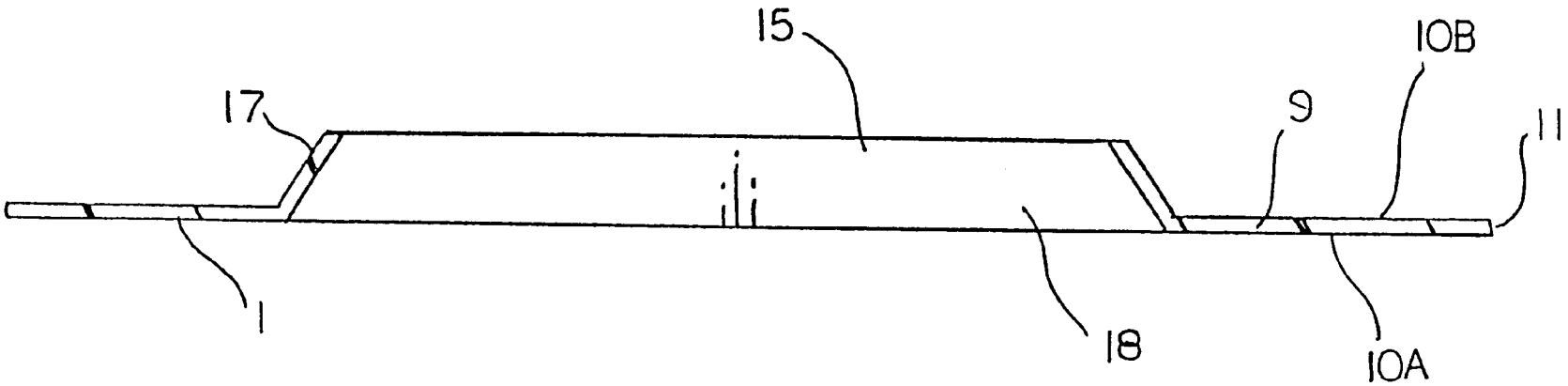
FIG. 2 is a vertical cross section of the present invention along the lines 4—4 of FIG. 1.
Figure 3:
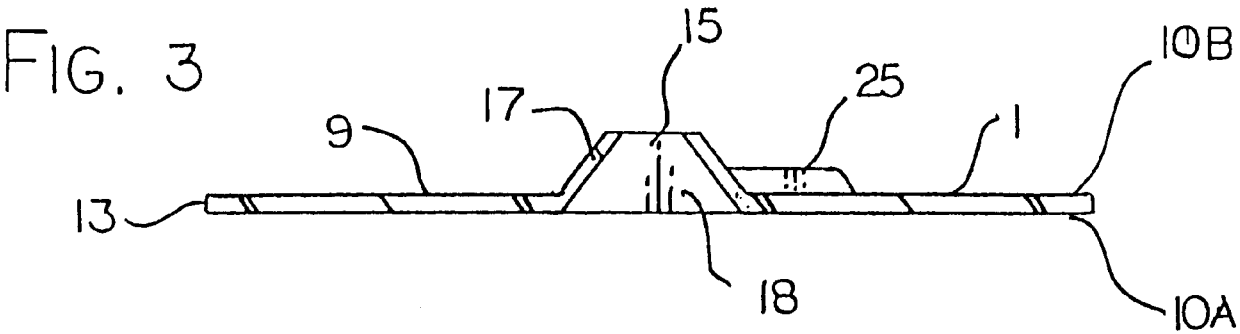
FIG. 3 is a horizontal cross section of the present invention along the lines 3—3 of FIG. 1.
Figure 4:
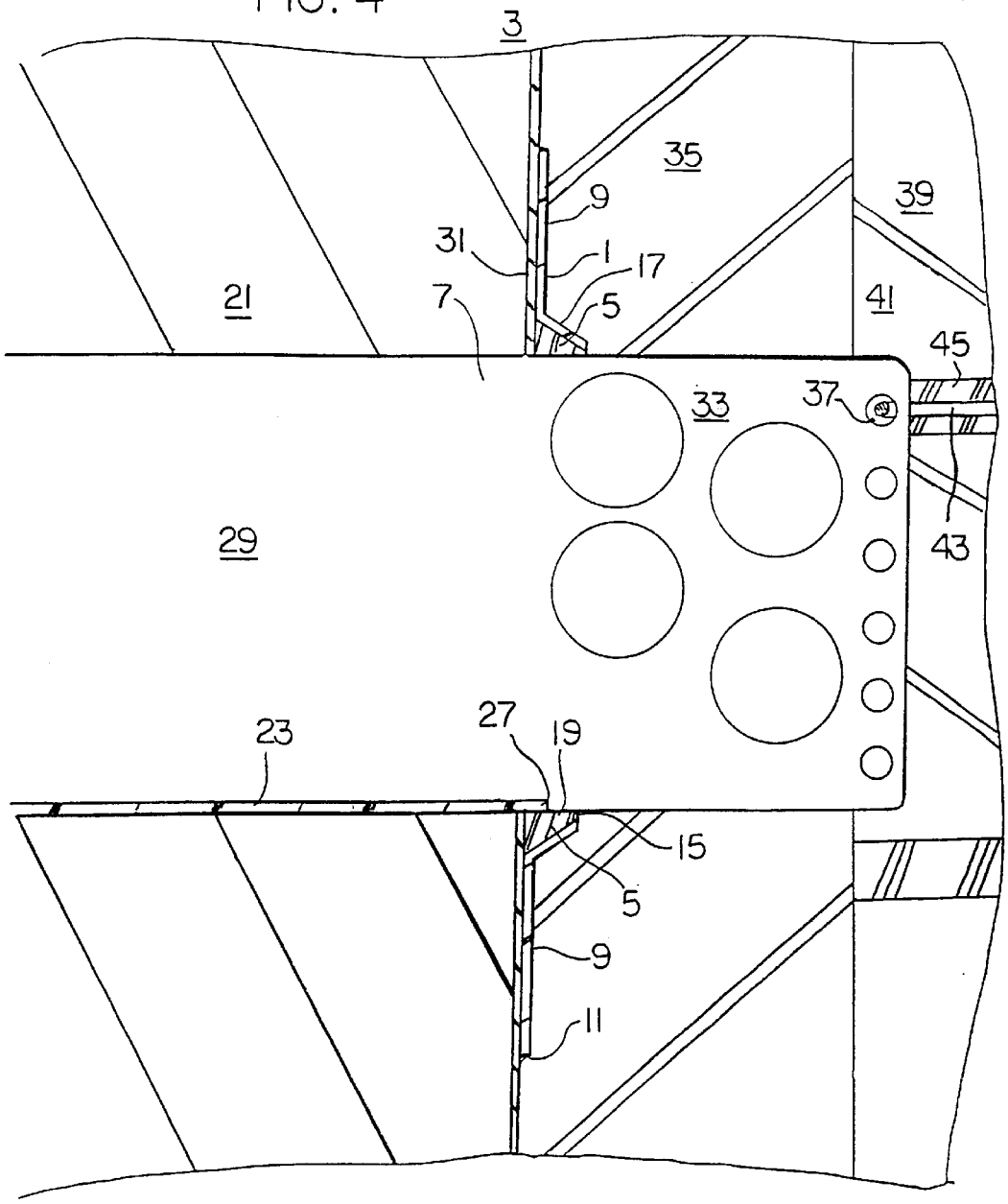
FIG. 4 is a vertical cross section of the present invention mounted on the building along the lines 4—4 of FIG. 1.

A sealing plate 1 for use with a building 3 is arranged to create a seal 5 around a wall tie 7.

The sealing plate 1 has a flat plate body 9 which is arranged to surround the area of the wall tie 7. The body 9 is rectangular in shape being sufficiently sized such that an appropriate seal is created. The sealing plate has a first inner surface 10A which faces inwards, relative to a wall surface, and a second outer surface 10B which faces outwards, relative to the wall surface. A first pair of ends 11 are arranged to be vertically orientated when the sealing plate is applied to a wall tie 7 and a second pair of ends 13 are arranged to be horizontally orientated when the sealing plate is applied to a wall tie 7. The first ends 11 are longer in length than the second ends 13 and the adjoining corners 14 are curved such that the sealing plate has a constant smooth outer edge 16. An elongate slot 15 on the body 9 is parallel to the first ends 11 and is arranged to receive a wall tie 7. A raised protrusion 17 around the slot 15 on the body 9 on the outer surface is arranged to contain flowable sealant material 19 around the wall tie 7 applied to contact an interior portion 18 at the inner surface, defined by the raised protrusion.

A first plate portion 29 of the wall tie 7 is mounted on an inner wall structure 21, made of concrete or the like. A fold portion 23 on the first portion 29 is folded at a right angle for support in the inner wall structure 21. A second raised protrusion 25 on the body 9 is arranged to receive an protruding end 27 of the fold portion 23.

An air permeable sheet material 31 is placed over the inner wall structure 21 and is slit in appropriate locations to allow a second plate portion 33 of the wall tie 7 to be inserted therethrough. The slit made of the second portion 33 is generally done when the sheet material is applied by a worker, causing the slits to be inconsistent is size and are usually not exactly cut. When the second plate 33 is inserted through the sheet material 31 a seal must be made to ensure that the sheet material 31 continues to be air permeable. A bead of flowable sealant material 17 is placed around the second plate 33 on the slit to create a seal. The sealing plate 1 is then placed on to the wall tie 7 such that the inner surface of the sealing plate contacts the sheet material 31 such that the bead fills the void of the raised protrusion creating a seal around the slit. Generally, the seal would be attempted by spreading the sealant around the slit with a tool which did not usually create an air tight seal.

An insulation layer 35 is placed against the sheet material and is pressed on tightly. The second plate 33 is inserted through the insulation 35. The sealing plate is pressed up tightly and protects the sealant material 17 from sticking to the insulation. As well known in the construction business, when the wind forces against the wall it fills the voids between the layers of material pulling and pressing the layer inward and outward. The sealing plate protects against the wind disallowing the sealant to stick to the insulation.

The second plate has a plurality of holes 37 at the outermost end so that bricks 39 on the outer wall structure 41 are supported, as well known in construction. A wire 43 is inserted through the holes 37 and placed into the mortar 45 for support.

The sealing plate provides a uniform bead of sealant material at correct thickness around the slot and supports the sealant and protects it from contact with the insulation.

Figure 5:
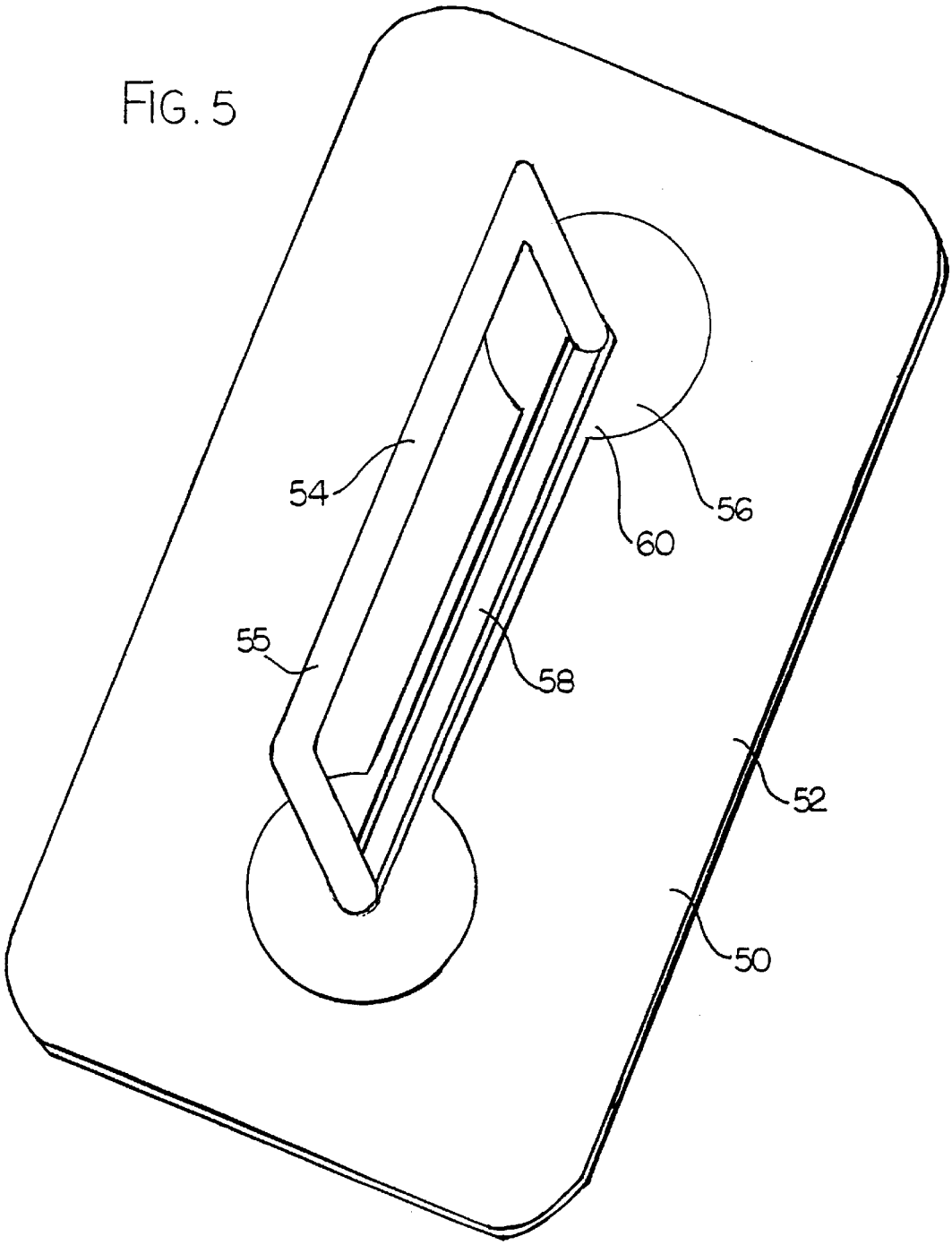
FIG. 5 is an isometric view of a second embodiment of the present invention mounted on the building.
Figure 6:
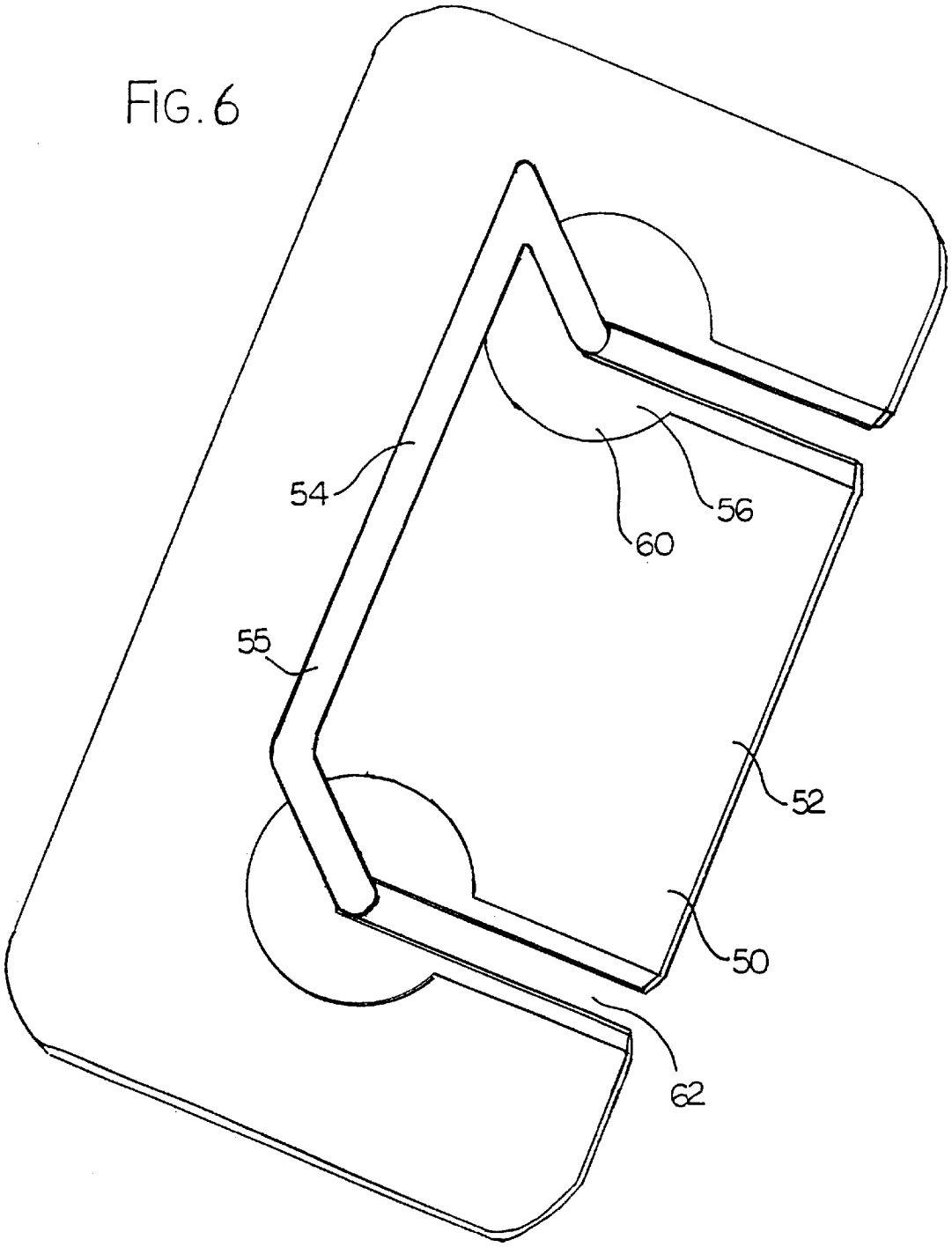
FIG. 6 is an isometric view of another embodiment of the present invention.

In a second embodiment, shown in FIG. 5, a sealing plate 50 has a flat body 52 which arranged to surround the area of a wall tie 54. The body is rectangular in round shape or a square plate. The wall tie has an elongate body 55 which is curved at a square shape where one end is in the wall and another end extends out from the wall. A raised protrusion 56 at respective ends of the body 58 which surrounds the wall tie on the body is shape being sufficiently sized such that an appropriate seal is created. The plate can be a single arranged to contain flowable sealant material 60 around the wall tie to create an air tight or air vapor tight seal. A slot 58 extends along the plate from each of the raised protrusions so that the plate can be slide over the wall tie. The slot has a sealant material to create the air tight seal. In an alternate arrangement, a pair of slide slots 62 extend outwardly and parallel from each of the raised protrusions so that the plate can be slide sideways over the wall tie which eliminates the need for the slot.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A building comprising, an inner wall structure;

an air impermeable sheet material for covering the inner wall structure and defining an air impermeable barrier;

an insulation material on top of the sheet material;

an outer wall structure outside of the insulation material;

a wall tie mounted on the inner wall structure arranged to attach to the outer wall structure for support;

the wall tie comprising a first portion which is mounted on the inner wall structure, a second portion connected to the first portion and extending therefrom inserted through an opening on the sheet material and through a second opening on the insulation material, the second portion having at least one hole in which a suitable mount means is inserted and attached to the outer wall structure connecting the inner wall structure and the outer wall structure; and a sealing plate between the sheet material and the insulation material comprising;

a sealing material;

a generally flat plate body defining a covering portion to create a seal around the sealing material such that the sealing material is trapped in the sealing plate;

a receive portion on the body for receiving the wall tie;

and a raised protrusion on the body at the receive portion for allowing the sealing material to form a bead.

2. The building according to claim 1 wherein the first portion defines a plate which is vertically mounted on the inner wall structure and the second portion defines a plate.

3. The building according to claim 1 wherein the wall tie has a fold portion at the first portion which is folded at a right angle to correspond with the inner wall structure.

4. The building according to claim 3 wherein a second raised protrusion on the body is arranged for receiving the folded portion.

5. The building according to claim 1 wherein the sealing material is applied around the perimeter of the wall tie such that the sealing material fills the raised protrusion on the body.

6. The building according to claim 1 wherein the wall tie is an elongate rod which is formed into a square shape.

7. The building according to claim 1 wherein the plate has an inner surface and an outer surface, the raised protrusion is located on the outer surface and the bead of sealant material is applied around the wall tie such that the interior of the raised protrusion at the inner surface is filled to provide a seal around the wall tie.

8. The building according to claim 7 wherein the raised protrusion extends upwardly at an incline from the outer surface.

* * * * *